US007443305B2

(12) United States Patent
Verdiramo

(10) Patent No.: US 7,443,305 B2
(45) Date of Patent: Oct. 28, 2008

(54) HAND WASH MONITORING SYSTEM AND METHOD

(76) Inventor: Vincent L. Verdiramo, 57 Loft Dr., Martinsville, NJ (US) 08836

( * ) Notice: Subject to any disclaimer, the term of this patent is extended or adjusted under 35 U.S.C. 154(b) by 537 days.

(21) Appl. No.: 10/959,895

(22) Filed: Oct. 6, 2004

(65) Prior Publication Data

US 2006/0071799 A1 Apr. 6, 2006

(51) Int. Cl.
*G08B 23/00* (2006.01)

(52) U.S. Cl. ..... 340/573.5; 340/573.1; 340/691.1; 340/825.29; 4/665; 4/619

(58) Field of Classification Search ..... 340/573.5, 340/573.1, 691.1, 825.29; 4/619, 628, 665, 4/664; 510/109, 138
See application file for complete search history.

(56) References Cited

U.S. PATENT DOCUMENTS 5,199,118 A * 4/1993 Cole et al. ..... 4/619
5,202,666 A * 4/1993 Knippscheer ..... 340/573.1
5,257,423 A * 11/1993 Jacobsen et al. ..... 4/630
5,522,411 A * 6/1996 Johnson ..... 134/95.2
5,812,059 A * 9/1998 Shaw et al. ..... 340/573.1
5,945,910 A * 8/1999 Gorra ..... 340/573.1
5,952,924 A * 9/1999 Evans et al. ..... 340/573.1
6,038,331 A * 3/2000 Johnson ..... 382/100
6,206,238 B1 * 3/2001 Ophardt ..... 222/1
6,236,317 B1 * 5/2001 Cohen et al. ..... 340/573.1
6,426,701 B1 * 7/2002 Levy et al. ..... 340/573.1
6,727,818 B1 * 4/2004 Wildman et al. ..... 340/573.1

OTHER PUBLICATIONS

Verdiramo, Vincent L., Provisional Patent Application entitled "System and Method for Monitoring and Tracking Individuals", Mar. 18, 2002.

* cited by examiner

*Primary Examiner*—Daniel Previl
(74) *Attorney, Agent, or Firm*—Thomas J. Germinario

(57) ABSTRACT

An identification badge worn by an individual is sensed when that individual enters a lavatory. The individual is also provided with an indication device which is worn on or about the hands. Inside the lavatory, there is also provided a hand cleaning station which includes a sensor that determines whether the indicating device is in close proximity and dispenses soap on the individual's hands, then provides an appropriate indication to a computer system. Should the badge sensor sense the individual's departure from the lavatory without an appropriate indication being generated by the indicator sensor, a warning signal is generated, which is sent to the computer system and to an appropriate officer, who can then address the individual.

18 Claims, 5 Drawing Sheets

HAND WASH MONITORING SYSTEM AND METHOD

FIELD OF THE INVENTION

The present invention relates generally to security systems and, more particularly, concerns a method and system for monitoring whether individuals using a lavatory or similar facility wash their hands.

BACKGROUND OF THE INVENTION

Individuals who handle food, for example, in restaurants are at a high risk of spreading disease if they do not handle food properly. One of the most common risks occurs when such individuals do not wash their hands after using a lavatory or bathroom. For this reason, most municipalities have laws which specifically require hand washing by such individuals and also require the proprietor to post notices informing individuals that they must wash their hands before returning to work.

Nevertheless, individuals will occasionally fail to wash their hands under these circumstances, whether by inadvertence or laziness. It would therefore be desirable to have a system which could monitor individuals using a lavatory, without invading their privacy, which could assure that they wash their hands as required by law and dictated by good hygienic practice.

SUMMARY OF THE INVENTION

In accordance with a preferred embodiment of the present invention, an identification badge worn by an individual is sensed when that individual enters a lavatory. The individual is also provided with an indication device which is worn on or about the hands. Inside the lavatory, there is also provided a hand cleaning station which includes a sensor that determines whether the indicating device is in close proximity and dispenses soap on the individual's hands, then provides an appropriate indication to a computer system. Should the badge sensor sense the individual's departure from the lavatory without receiving an appropriate indication from the indicator sensor, a warning signal is generated, which is sent to the computer system and to an appropriate officer, who can then address the individual.

BRIEF DESCRIPTION OF THE DRAWINGS

The foregoing brief description, as well as other features and advantages of the present invention will be understood more completely from the following detailed description of a presently preferred, but nonetheless illustrative, embodiment of the invention, with reference being had to the accompanying drawings in which.

DETAILED DESCRIPTION OF THE PREFERRED EMBODIMENT

Figure 1:
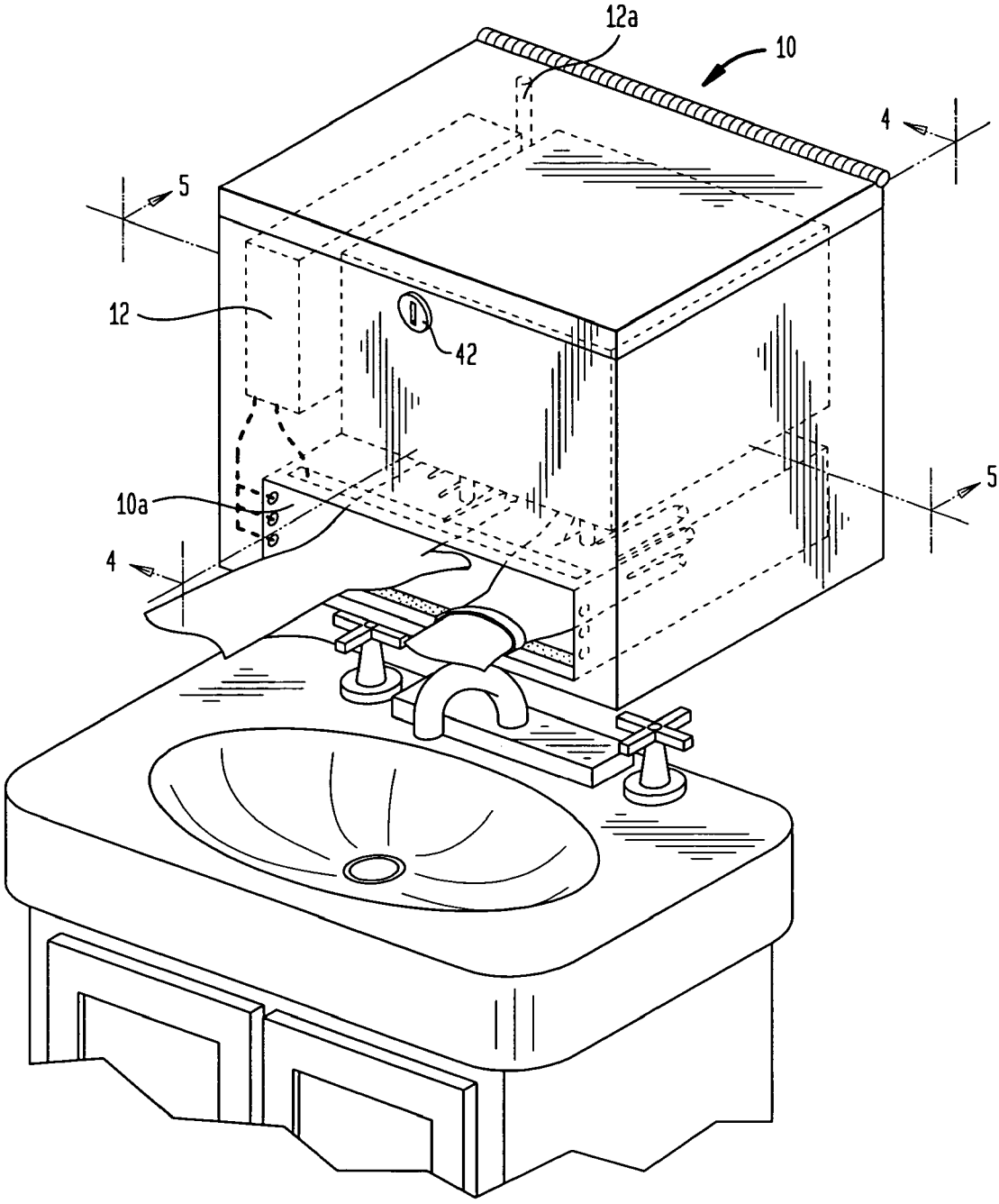
FIG. 1 is a perspective view of a hand wash monitoring system in use in conjunction with a lavatory, with an individual hands being shown inserted therein.

FIG. 1 is a perspective view illustrating a hand wash monitoring system S embodying the present invention, in use by an individual. A hand cleaning station 10 is provided in the washroom in close proximity to the sink, in this case just above the sink. Station 10 is provided with an opening 10*a*, into which an individual inserts his hands prior to washing them. As will be explained below, the insertion of the hands is sensed by the station 10, which dispenses soap. The station also provides an indication to the system that the hands have been inserted.

Figure 3:
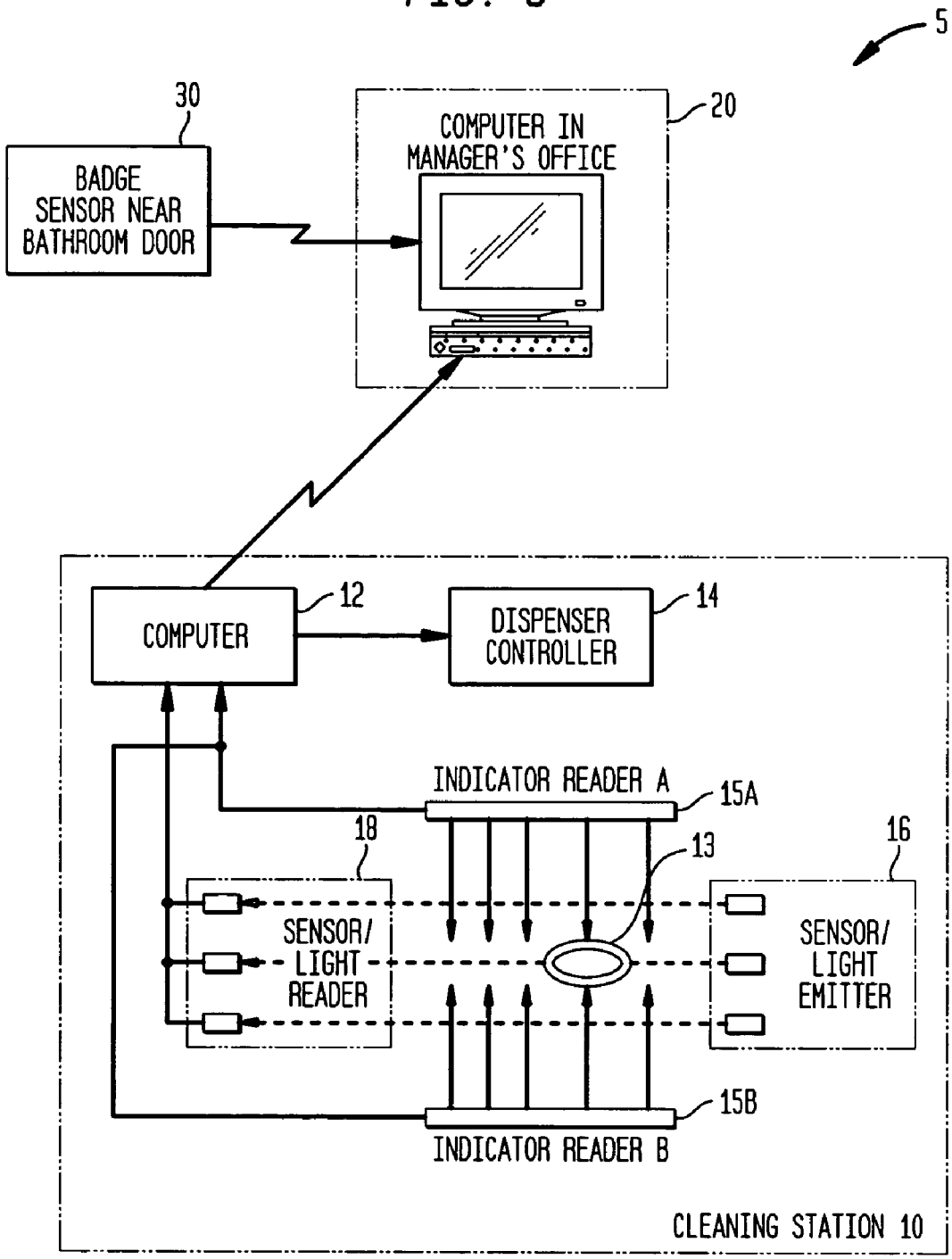
FIG. 3 is a functional block diagram illustrating the cooperation of the various components of a hand wash monitoring system.

FIG. 3 is functional block diagram illustrating the major components of the hand wash system and their cooperation. The three major components are a central computer 20 provided, for example, in a manager's office; a badge sensor 30 provided near the lavatory door, where an individual would enter the lavatory; and the hand cleaning station 10 described previously. Badge sensor 30 is coupled to the computer 20, preferably wirelessly, and senses an identification badge worn by an individual when he enters the lavatory.

Hand cleaning station 10 includes a computer 12, which provides local control and communicates, preferably wirelessly, with the main computer 20. As explained below in using the present invention, the individual will wear an indicator 13 on or about his hands. In the preferred embodiment, this is a wristband. A pair of indicator readers 15A, 15B are located inside the unit 10, and positioned so that the indicating device 13 must be located between them in order to be sensed by both. At the same time, a light emitter 16 projects a series of light beams to a light reader 18. When the hands are properly positioned inside station 10, the light beam is broken and an appropriate indication is provided by light reader 18 to computer 12. Sensors which operate this way are in common use today in automatic toilets and sinks. Computer 12 then operates dispenser controller 14 so as to deposit a hand wash solution, such as soap upon the individual's hands. At the same time, indicator readers 15A, 15B provide an indication to computer 12 that the individual inserted his hands into station 10.

Figure 2:
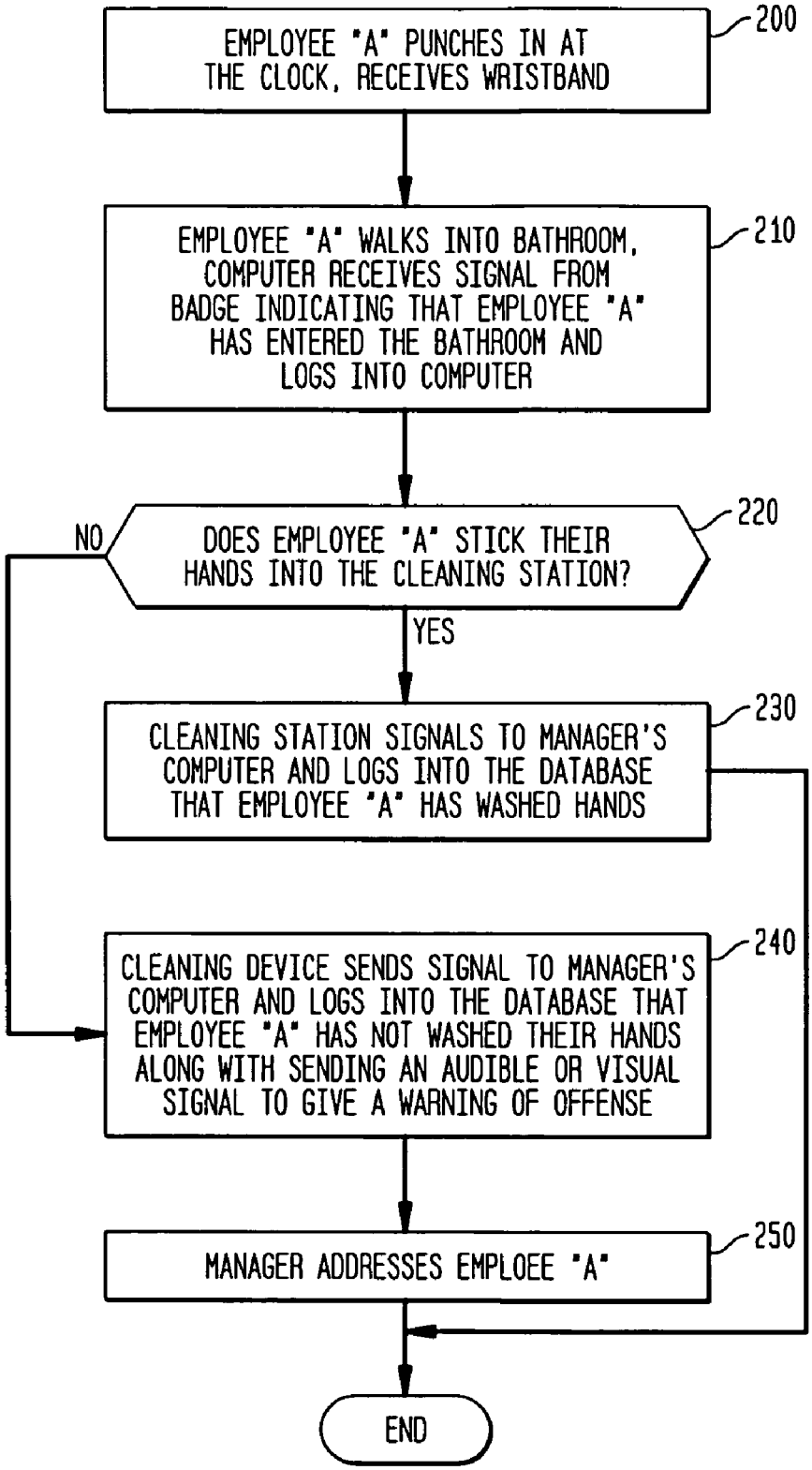
FIG. 2 is flowchart illustrating the operation of the hand wash monitoring system.

FIG. 2 is a flowchart illustrating the operation of the preferred embodiment of the present invention. In this example, it is assumed that the individual is an employee at an establishment, such as a restaurant. At step 200, the employee receives an indicator device 13 in form of a wristband when he arrives at the place of employment or punches into a clock. It will be appreciated that the indicator device could also be in the form of a ring or band worn on a finger or any other type of a device worn on or about the hands. It will also be appreciated that the indicator device could be provided to the individual at the time that he enters the bathroom. In any case, it is assumed that the establishment requires every employee to wear an identification badge. Many such types of badges are available today, including ones that can be sensed by a remote sensor as an individual wearing the badge passes. Such a sensor 30 is provided in the vicinity of the bathroom door and senses the identity of an individual passing through the door. This information and the identity of the individual are transmitted to the main computer 20 (Step 210).

As explained previously, an individual would be expected to place his hands into the hand cleaning station 10 prior to departing from the bathroom. This would cause the indicator readers 15A, 15B to sense the indicator device 13 and send an appropriate message to computer 12. At the same time, soap would be deposited upon the individual's hands, and he would need to wash his hands in order to remove it.

At step 220, a test is performed to determine whether an appropriate signal was received from indicators 15A, 15B. This could occur when badge sensor 30 senses that the individual has left the bathroom. If so, computer 12 signals to computer 20 that it has received an appropriate indication and an entry could be made in a database within computer 20 indicating that the individual washed his hands (Step 230).

Should computer 12 not have received the indication tested for in Step 220 when the individual leaves the bathroom, computer 12 signals to computer 20 that the employee failed to wash his hands and an appropriate entry made in the database (Step 240). An appropriate visual or audible alarm could also be provided to draw the attention of a manager and to indicate the identity of the individual who failed to wash his hands. The manager could then have an appropriate discussion with that individual and assure that he returns to wash his hands (Step 250).

Figure 4:
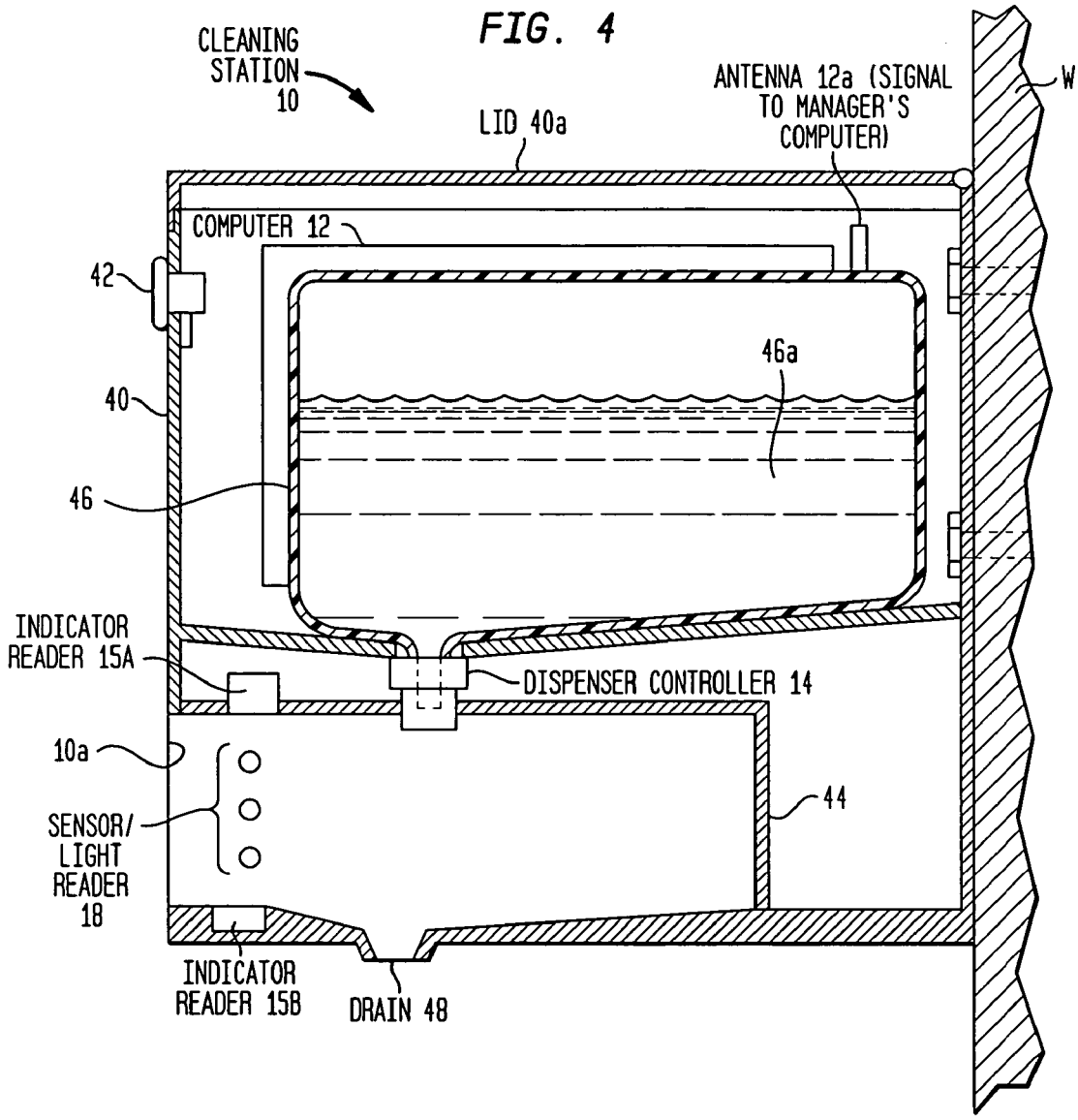
FIG. 4 is an enlarged, sectional view taken along contour 4-4 in FIG. 1 and looking in the direction of the arrows to illustrate internal details of the hand cleaning station.
Figure 5:
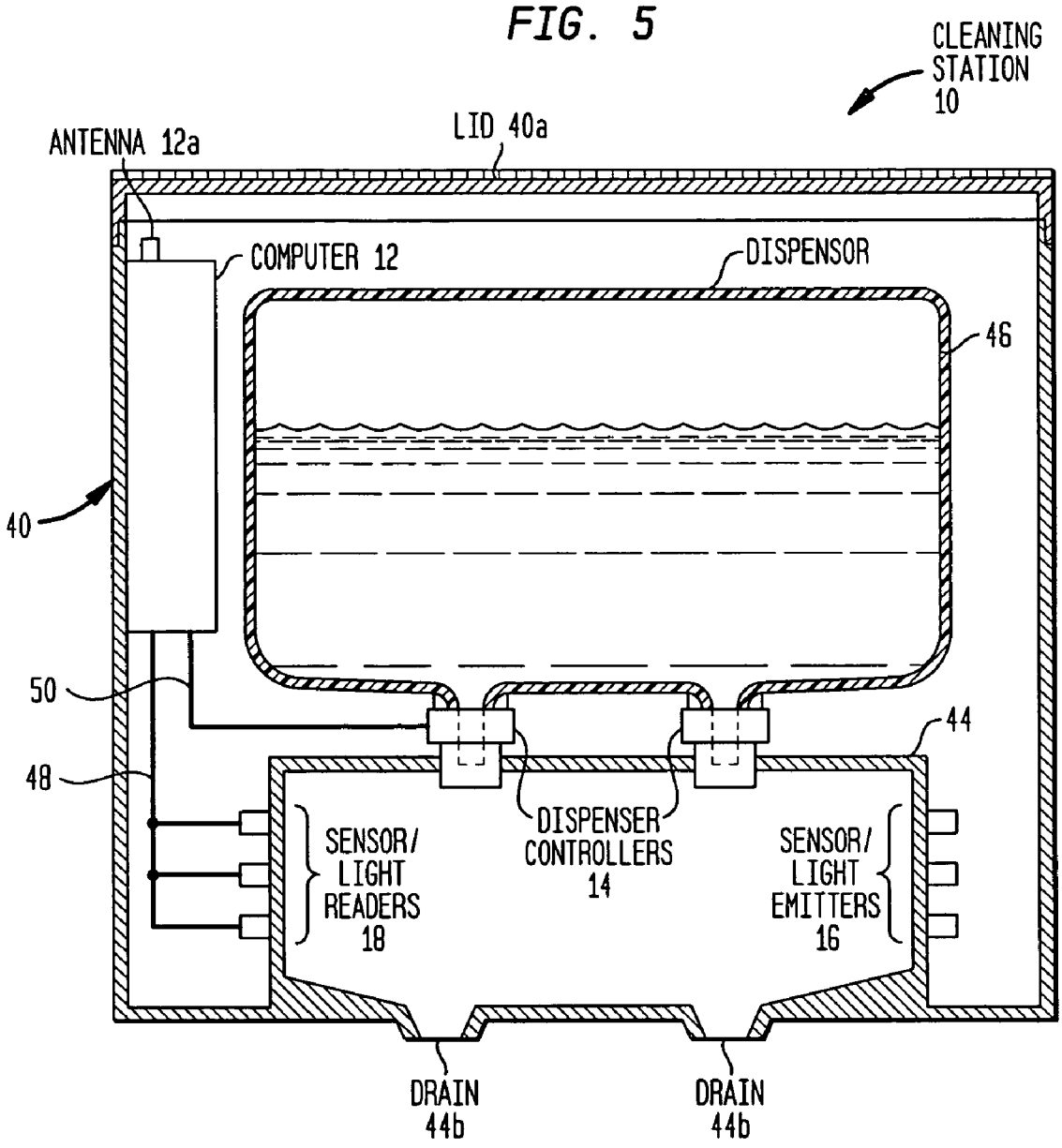
FIG. 5 is a sectional view taken along line 5-5 in FIG. 1 and looking in the direction of the arrows to illustrate further internal details of the cleaning station.

FIGS. 4 and 5 are sectional views illustrating the preferred inner construction of the cleaning station 10. As may be seen, cleaning station 10 is provided inside an enclosure 40, which includes a hinged lid 40*a*, through which the interior of the enclosure may be accessed. The lid is prevented from being opened by means of a lock 42. Computer 12 is mounted on the interior of the enclosure 40 and is presumed to have a wireless transmitter with an antenna 12*a*. Within enclosure 40, there is provided an enclosed compartment 44 which is accessed via opening 10*a*. Above the compartment 44, there is provided a tank 46 containing soap solution 46*a*. Tank 46 communicates with compartment 44 through the dispenser controllers 14, which enter compartment 44 from above.

Indicator readers 15A and 15B are provided near the front of compartment 44 in upper and lower walls, respectively. Also, light emitters 16 are provided on a right-hand wall of compartment 44 and light readers 18 are provided on the left-hand wall, with both in positions to assure that the light beam is broken when the individual's hands are inserted into compartment 44. In the bottom wall of compartment 44, there are provided drains 44*b*, 44*b*, which permits excess soap solution to be disposed through the sink which lies below. Computer 12 is coupled to sensors 18 via leads 48 and to controller 14 via leads 50. As may be seen in FIG. 4, the enclosure 40 is conveniently mounted, by conventional means, to a wall W within the lavatory.

Although a preferred embodiment of the invention has been disclosed for illustrative purposes, those skilled in the art will appreciate that many additions, modifications and substitutions are possible, without departing from the scope and spirit of the present invention as defined by the accompanying claims.

I claim:

1. A system for monitoring cleaning of the hands of one or more monitored individuals, comprising:

(a) an enclosed area accessed by one or more doors;

(b) one or more identity sensors located within the enclosed area, each identity sensor being proximate to one of the doors;

(c) one or more cleaning stations located within the enclosed area; each cleaning station comprising one or more sinks, each sink having one or more water faucets, one or more soap dispensers and one or more drains;

(d) one or more indicator readers located within each of the cleaning stations, each indicator reader being proximate to one of the sinks, such that each sink has proximate to it one or more indicator readers;

(e) an identification device that is worn by each monitored individual, such that when the monitored individual enters or leaves the enclosed area through one of the doors, the identity sensor that is proximate to the door senses the identification device and transmits identity of the monitored individual who has passed through the door to a system control device;

(f) one or more indicator devices that is/are worn on or about one or both hands of each monitored individual, such that when the hands of the monitored individual are placed in the vicinity of one of the sinks, the indicator reader(s) sense(s) the presence of the indicator device(s) and transmit a signal to the system control device indicating that the monitored individual has washed his/her hands; and (g) an alarm that generates a warning signal whenever the system control device has received transmissions from the identity sensor(s) indicating that the monitored individual has entered and exited from the enclosed area without the system control device also having received a signal from the indicator reader(s) that the monitored individual has washed his/her hands.

2. The system according to claim 1, wherein the system control device is a local computer.

3. The system according to claim 2, wherein the local computer is located within the enclosed area.

4. The system according to claim 3, wherein the local computer is located within the cleaning station.

5. The system according to any of claims 2-4, wherein the local computer transmits a warning signal and/or a warning message to a remote computer whenever the system control device has received transmissions from the identity sensor(s) indicating that the monitored individual has entered and exited from the enclosed area without the system control device also having received a signal from the indicator reader (s) that the monitored individual has washed his/her hands.

6. A system for monitoring cleaning of the hands of one or more monitored individuals, comprising:

(a) an enclosed area accessed by one or more doors;

(b) one or more identity sensors located within the enclosed area, each identity sensor being proximate to one of the doors;

(c) one or more cleaning stations located within the enclosed area; each cleaning station comprising one or more sinks, each sink having one or more water faucets, one or more soap dispensers and one or more drains;

(d) one or more pairs of indicator readers located within each of the cleaning stations, each pair of indicator readers comprising an indicator reader A and an indicator reader B, indicator reader A being located proximate to the soap dispenser and indicator reader B being located below indicator reader A, such that the space between indicator reader A and indicator reader B constitutes a dispenser opening through which the hands of the monitored individual are inserted in order to access the soap dispenser;

(e) an identification device that is worn by each monitored individual, such that when the monitored individual enters or leaves the enclosed area through one of the doors, the identity sensor that is proximate to the door senses the identification device and transmits identity of the monitored individual who has passed through the door to a system control device;

(f) one or more indicator devices that is/are worn on or about one or both hands of each monitored individual, such that when the hands of the monitored individual are placed beneath the soap dispenser in the dispenser opening between indicator reader A and indicator reader B, both indicator readers A and B sense the presence of the indicator device(s) and transmit a signal to the system control device indicating that the monitored individual has washed his/her hands; and (g) an alarm that generates a warning signal whenever the system control device has received transmissions from the identity sensor(s) indicating that the monitored individual has entered and exited from the enclosed area without the system control device also having received a signal from both indicator reader A and indicator reader B that the monitored individual has washed his/her hands.

7. The system according to claim 6, further comprising:

(h) a sensor light emitter that projects one or more light beams across the dispenser opening to a sensor light reader, such that when the hands of the monitored individuals are inserted into the dispenser opening to access the soap dispenser, the light beam(s) is/are broken and a corresponding signal is sent to a dispensing controller, which dispensing controller responds to the signal by activating the soap dispenser to deposit a hand wash solution on the hands of the monitored individual.

8. The system according to either of claims 6 or 7, wherein the system control device is a local computer.

9. The system according to claim 8, wherein the local computer is located within the enclosed area.

10. The system according to claim 9, wherein the local computer is located within the cleaning station.

11. The system according to claim 8, wherein the local computer transmits a warning signal and/or warning message to a remote computer whenever the system control device has received transmissions from the identity sensor(s) indicating that the monitored individual has entered and exited from the enclosed area without the system control device also having received a signal from both indicator reader A and indicator reader B that the monitored individual has washed his/her hands.

12. The system according to either of claims 9 or 10, wherein the local computer transmits a warning signal and/or warning message to a remote computer whenever the system control device has received transmissions from the identity sensor(s) indicating that the monitored individual has entered and exited from the enclosed area without the system control device also having received a signal from both indicator reader A and indicator reader B that the monitored individual has washed his/her hands.

13. A method for monitoring cleaning of the hands of one or monitored individuals, comprising:

(a) sensing the identity of the monitored individual as he/she enters and exits an enclosed area;

(b) transmitting to a system control device an identification signal identifying the monitored individual who has entered and exited the enclosed area;

(c) detecting the presence of an indicator device worn on or about the hands of the monitored individual when his/her hands are positioned in a cleaning station between two paired indicator readers, which indicator readers are positioned one below the other, such that the space between the indicator readers constitutes a dispenser opening through which the hands of the monitored individual are inserted in order to access a soap dispenser in the cleaning station;

(d) transmitting a hand washing signal to a system control device when the indicator device is detected within the dispenser opening by the two paired indicator readers; and (e) generating a warning whenever the system control device has received an identification signal without having received a hand washing signal.

14. The method according to claim 13, further comprising:

(f) using an interrupted light beam to activate the soap dispenser when the hands of the monitored individual are inserted into the dispenser opening.

15. The method according to either of claims 13 or 14, wherein the system control device is a local computer.

16. The method according to claim 15, wherein the local computer is located within the enclosed area.

17. The method according to claim 16, wherein the local computer is located within the cleaning station.

18. The method according to either of claims 16 or 17, further comprising a step whereby the local computer transmits a warning signal and/or warning message to a remote computer whenever the system control device has received an identification signal without having received a hand washing signal.

* * * * *